US007718334B2

(12) United States Patent
Wu et al.

(10) Patent No.: US 7,718,334 B2
(45) Date of Patent: May 18, 2010

(54) IMAGING MEMBER HAVING PORPHINE OR PORPHINE DERIVATIVES

(75) Inventors: Jin Wu, Webster, NY (US); Marc J. Livecchi, Rochester, NY (US); James R. Backus, Webster, NY (US); Liang-bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 900 days.

(21) Appl. No.: 11/384,919

(22) Filed: Mar. 20, 2006

(65) Prior Publication Data

US 2007/0218377 A1 Sep. 20, 2007

(51) Int. Cl.
*G03G 5/047* (2006.01)

(52) U.S. Cl. ..... 430/58.5; 430/66; 399/159

(58) Field of Classification Search ..... 430/58.5, 430/66; 399/159
See application file for complete search history.

(56) References Cited

U.S. PATENT DOCUMENTS 4,518,669 A 5/1985 Yashiki
4,579,801 A 4/1986 Yashiki
4,775,605 A 10/1988 Seki et al.
5,017,449 A 5/1991 Yoshihara
5,344,733 A * 9/1994 Suzuki et al. ..... 430/58.5
5,344,734 A 9/1994 Monbaliu et al.
5,489,496 A 2/1996 Katayama et al.
5,641,599 A 6/1997 Markovics et al.
5,656,407 A 8/1997 Kawahara
5,721,080 A 2/1998 Terrell et al.
5,821,021 A * 10/1998 Kawahara ..... 430/78
6,180,309 B1 1/2001 Maty et al.
6,200,716 B1 3/2001 Fuller et al.
6,207,334 B1 3/2001 Dinh et al.
6,232,025 B1 * 5/2001 Srinivasan ..... 430/58.4
6,683,175 B2 * 1/2004 Tanaka ..... 540/145
7,399,565 B2 * 7/2008 Wu et al. ..... 430/65
7,527,904 B2 * 5/2009 Wu et al. ..... 430/59.1

OTHER PUBLICATIONS

U.S. Appl. No. 11/257,356, filed Oct. 24, 2005, Wu et al.

* cited by examiner

*Primary Examiner*—Mark F Huff
*Assistant Examiner*—Rachel L Burney
(74) *Attorney, Agent, or Firm*—Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to an additive of porphine or porphine derivatives to eliminate ghosting in specific conditions and improve image quality.

16 Claims, No Drawings

IMAGING MEMBER HAVING PORPHINE OR PORPHINE DERIVATIVES

CROSS REFERENCE TO RELATED APPLICATIONS

Reference is made to copending, commonly assigned U.S. patent application Ser. No. 11/257,356 to Wu et al., filed Oct. 24, 2005, entitled, "Imaging Member Having Porphine Additive."

BACKGROUND

Herein disclosed are imaging members, such as layered photoreceptor devices, and processes for making and using the same. The imaging members can be used in electrophotographic, electrostatographic, xerographic and like devices, including printers, copiers, scanners, facsimiles, and including digital, image-on-image, and like devices. More particularly, the embodiments pertain to an imaging member or a photoreceptor that incorporates specific molecules, namely porphine and porphine derivatives.

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoating layer and, in some belt embodiments, an anticurl backing layer. In the multilayer configuration, the active layers of the photoreceptor are the charge generation layer (CGL) and the charge transport layer (CTL). Enhancement of charge transport across these layers provides better photoreceptor performance.

The demand for improved print quality in xerographic reproduction is increasing, especially with the advent of color. Common print quality issues often arise in these conventional imaging members. For example, conventional materials used for photoreceptor layers have been problematic because print quality issues are strongly dependent on the quality of these layers. For example, charge deficient spots ("CDS") and bias charge roll ("BCR") leakage breakdown are problems the commonly occur. Another problem is "ghosting," which is thought to result from the accumulation of charge somewhere in the photoreceptor. Consequently, when a sequential image is printed, the accumulated charge results in image density changes in the current printed image that reveals the previously printed image.

Thus, conventional formulations used to make these photoreceptor layers, while suitable for their intended purpose, do suffer from print quality issues such as ghosting. However, changing the existing formulations to address such issues may impact the way the photoreceptor layers interact and could adversely affect other electrical properties.

Thus, there is a need, which is addressed herein, for a way to minimize or eliminate charge accumulation in photoreceptors, without sacrificing the other electrical properties.

The term "electrostatographic" is generally used interchangeably with the term "electrophotographic." In addition, the terms "charge blocking layer" and "blocking layer" are generally used interchangeably with the phrase "undercoat layer."

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein incorporated by reference in their entirety.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are herein incorporated by reference in their entirety.

SUMMARY

According to embodiments illustrated herein, there is provided a way in which print quality is improved, for example, CDS or ghosting is minimized or substantially eliminated in images printed in systems.

In one embodiment, there is provided an electrophotographic imaging member, comprising a substrate, a charge transport layer disposed over the substrate having a charge transport material dispersed therein, and an overcoat layer disposed over the charge transport layer, wherein at least one of the charge transport layer and overcoat layer includes a porphine additive, the porphine additive comprising a base skeleton of four pyrrole nuclei united through the α-positions by four methine groups to form a macrocyclic structure as shown below:

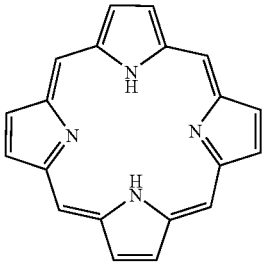

In another embodiment, there is provided an electrophotographic imaging member, comprising a substrate, a charge transport layer disposed over the substrate having a charge transport material dispersed therein, and an overcoat layer disposed over the charge transport layer, wherein both the charge transport layer and the overcoat layer include a porphine additive, the porphine additive comprising a base skeleton of four pyrrole nuclei united through the α-positions by four methine groups to form a macrocyclic structure as shown below:

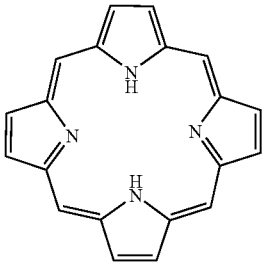

There is also provided an image forming apparatus for forming images on a recording medium comprising an electrophotographic imaging member having a charge retentive-surface to receive an electrostatic latent image thereon, wherein the electrophotographic imaging member comprises a substrate, a charge transport layer disposed over the substrate having a charge transport material dispersed therein, and an overcoat layer disposed over the charge transport layer, wherein at least one of the charge transport layer and overcoat layer includes a porphine additive, the porphine additive comprising a base skeleton of four pyrrole nuclei united through the α-positions by four methine groups to form a macrocyclic structure as shown below:

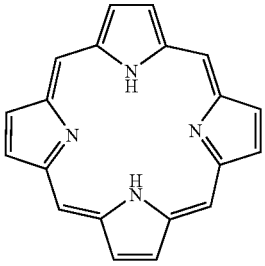

a development component adjacent to the charge-retentive surface for applying a developer material to the charge-retentive surface to develop the electrostatic latent image to form a developed image on the charge-retentive surface, a transfer component adjacent to the charge-retentive surface for transferring the developed image from the charge-retentive surface to a copy substrate, and a fusing component adjacent to the copy substrate for fusing the developed image to the copy substrate.

DETAILED DESCRIPTION

It is understood that other embodiments may be utilized and structural and operational changes may be made without departure from the scope of the embodiments disclosed herein.

The embodiments relate to an imaging member or photoreceptor that incorporates an additive to the formulation of at least one of the charge transport layer or overcoat layer that helps reduce, or substantially eliminates, specific printing defects in the print images that are present in specific conditions.

According to embodiments herein, an electrophotographic imaging member is provided, which generally comprises at least a substrate layer, an imaging layer disposed on the substrate, and an overcoat layer disposed on the imaging layer. The imaging member may include, as imaging layers, a charge transport layer or both a charge transport layer and a charge generation layer. The imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

In a typical electrostatographic reproducing apparatus such as electrophotographic imaging system using a photoreceptor, a light image of an original to be copied is recorded in the form of an electrostatic latent image upon a imaging member and the latent image is subsequently rendered visible by the application of a developer mixture. The developer, having toner particles contained therein, is brought into contact with the electrostatic latent image to develop the image on an electrostatographic imaging member which has a charge-retentive surface. The developed toner image can then be transferred to a copy substrate, such as paper, that receives the image via a transfer member.

Alternatively, the developed image can be transferred to another intermediate transfer device, such as a belt or a drum, via the transfer member. The image can then be transferred to the paper by another transfer member. The toner particles may be transfixed or fused by heat and/or pressure to the paper. The final receiving medium is not limited to paper. It can be various substrates such as cloth, conducting or non-conducting sheets of polymer or metals. It can be in various forms, sheets or curved surfaces. After the toner has been transferred to the imaging member, it can then be transfixed by high pressure rollers or fusing component under heat and/or pressure.

In embodiments, additives, namely porphine or porphine derivatives, are incorporated into at least one of the charge transport layer or the overcoat layer to reduce common print quality issues such as ghosting. The porphine additive generally comprises a base or fundamental skeleton of four pyrrole nuclei united through the α-positions by four methine groups to form a macrocyclic structure as shown below:

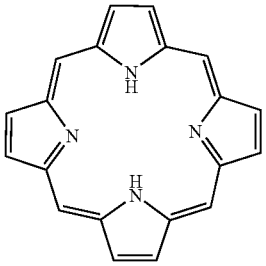

The embodiments may also include porphine additives of the following modified structure:

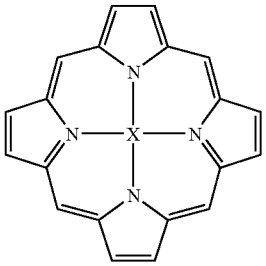

wherein X is a metal selected from the group consisting of Cu, Pd, V, Zn, Fe, Ga, Sn, Mn and mixtures thereof. In the Examples below, various porphine derivatives are shown. Incorporating porphine or porphine derivatives into the surface layers of the imaging member has demonstrated to substantially reduce ghosting and CDS levels in xerographic reproduction.

Typical porphine additives that can be used with embodiments disclosed herein include, but are not limited to, (1) 21H,23H-Porphine, (2) meso-Tetraphenylporphine-4,4',4",4'"-tetracarboxylic acid, (3) 5,10,15,20-Tetra(4-pyridyl)-21H, 23H-porphine, (4) 5,10,15,20-Tetraphenyl-21H,23H-porphine, (5) 5,10,15,20-Tetrakis(o-dichlorophenyl)-21H, 23H-porphine, (6) 5,10,15,20-Tetrakis(4-trimethylammoniophenyl)porphine tetrachloride, (7) meso-Tetraphenylporphine-4,4',4',4'"-tetracarboxylic acid copper (II), (8) 5,10,15,20-Tetrakis(4-sulfonatophenyl)-21H, 23H-porphine copper(II), (9) 5,10,15,20-Tetrakis(pentafluorophenyl)-21H,23H-porphine palladium(II), (10) 2,3,7,8,12,13,17,18-Octaethyl-21H,23H-porphine vanadium (IV) oxide, (11) Phytochlorin, (12) 5,10,15,20-Tetrakis(3-hydroxyphenyl)-21H,23H-porphine, (13) 3,8,13,18-Tetramethyl-21H,23H-porphine-2,7,12,17-tetrapropionic acid dihydrochloride, (14) 8,13-Divinyl-3,7,12,17-tetramethyl-21H,23H-porphine-2,18-dipropionic acid cobalt(III) chloride, (15) 8,13-Bis(ethyl)-3,7,12,17-tetramethyl-21H,23H-porphine-2,18-dipropionic acid chromium(III) chloride, (16) 3,7,12,17-Tetramethyl-21H, 23H-porphine-2,18-dipropionic acid dihydrochloride, (17) meso-Tetraphenylporphine-4,4',4",4'"-tetracarboxylic acid, iron (III) chloride, (18) 8,13-Bis(1-hydroxyethyl)-3,7,12,17-tetramethyl-21H,23H-porphine-2,18-dipropionic acid, (19) 5,10,15,20-Tetrakis(4-sulfonatophenyl)-21H,23H-porphine, manganese (III) chloride, (20) Pyropheophorbide-α-methyl ester, (21) 5,10,15,20-Tetraphenyl-21H,23H-porphine nickel(II), (22) N-Methyl Mesoporphyrin IX, (23) 8,13-Bis(vinyl)-3,7,12,17-tetramethyl-21H,23H-porphine-2,18-dipropionic acid, (24) 29H,31H-tetrabenzo porphine, (25) Uroporphyrin I dihydrochloride, (26) 8,13-Bis(vinyl)-3,7,12,17-tetramethyl-21H,23H-porphine-2,18-dipropionic acid zinc(II), (27) 5,10,15,20-Tetrakis(1-methyl-4-pyridinio) porphine tetra(p-toluenesulfonate), (28) 8,13-Bis(ethyl)-3,7,12,17-tetramethyl-21H,23H -porphine-2,18-dipropionic acid tin(IV) dichloride, and the like and the mixtures thereof. The chemical structures are shown below:

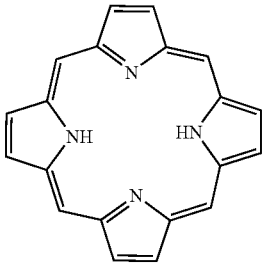

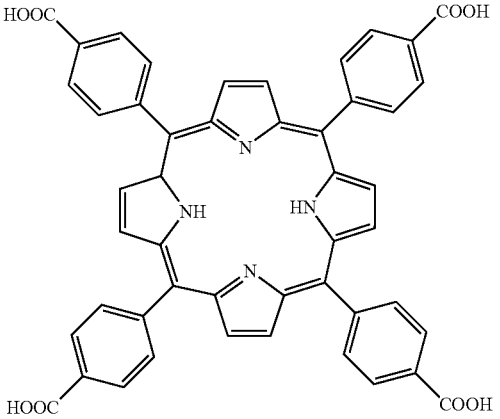

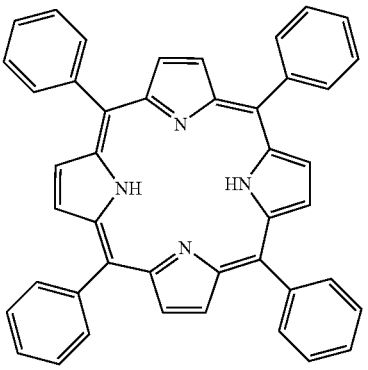

-continued
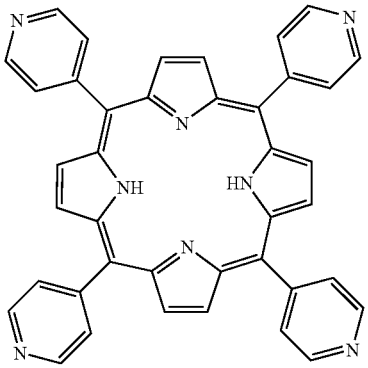
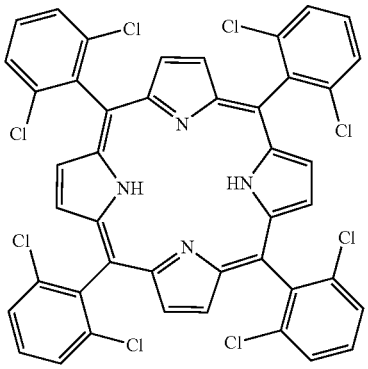
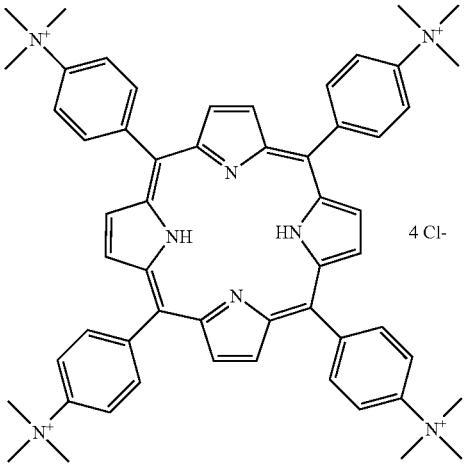
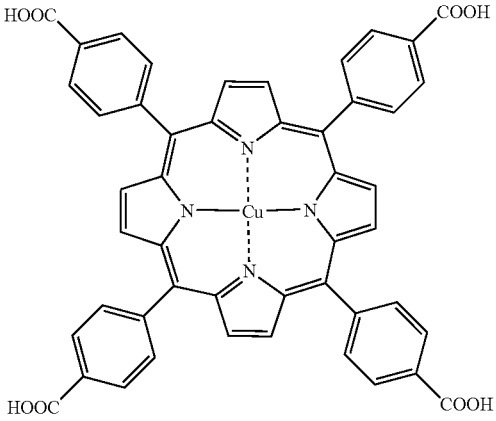
-continued
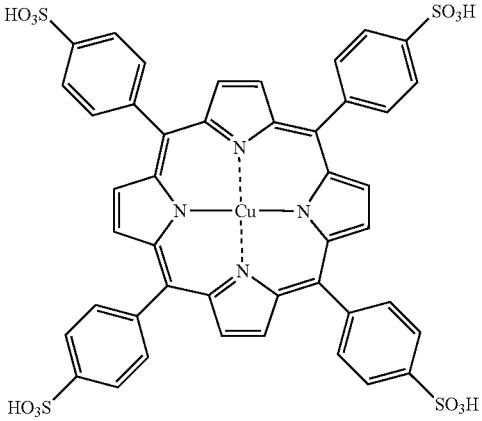
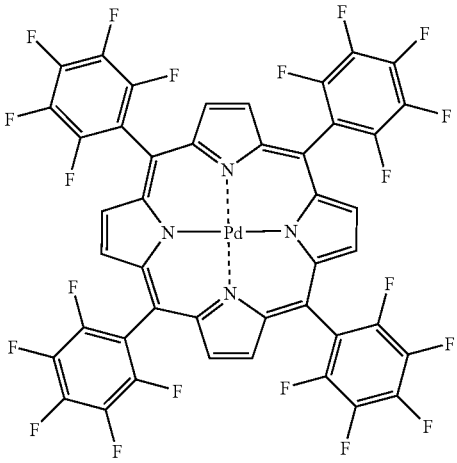
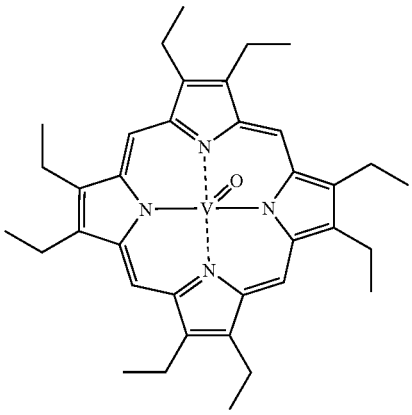

-continued
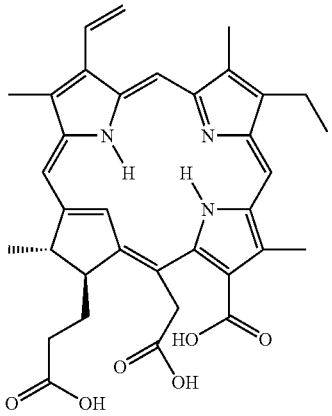
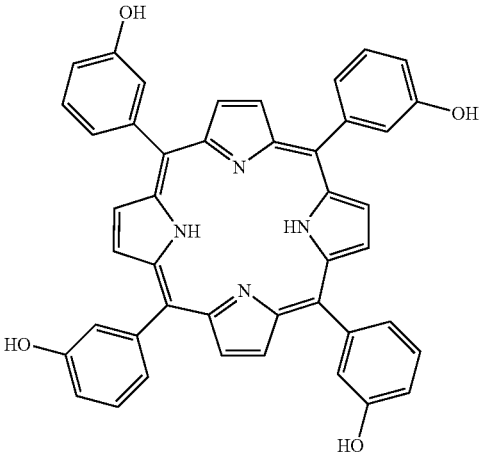
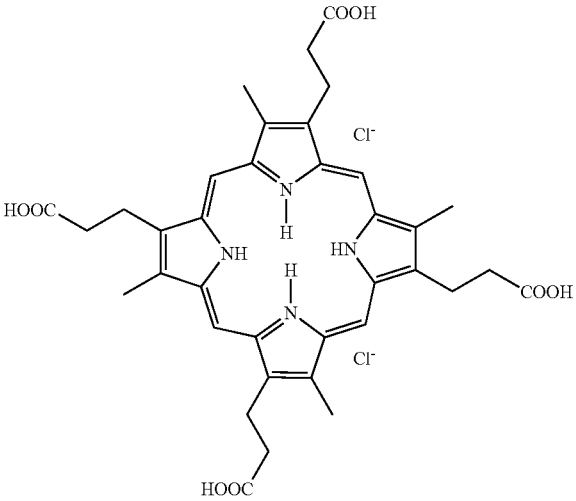
-continued
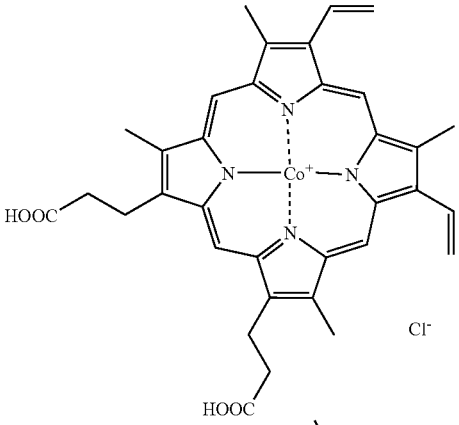
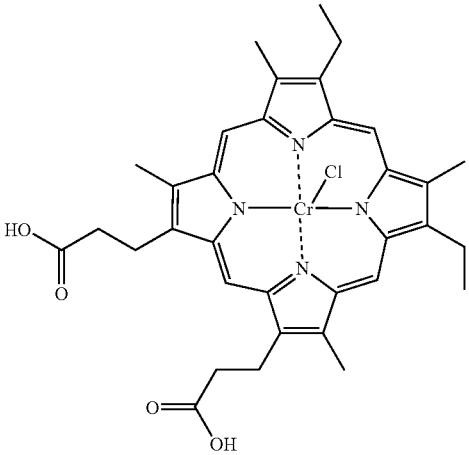
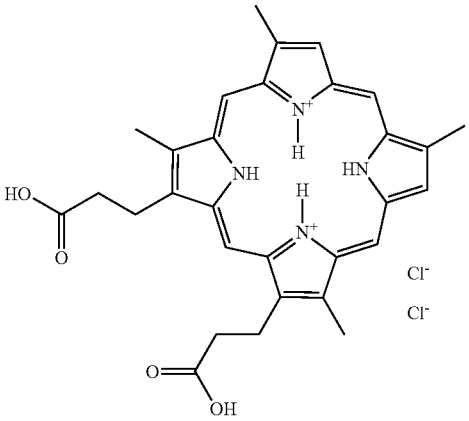
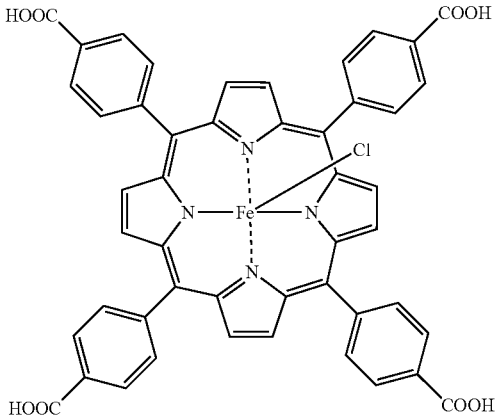

-continued
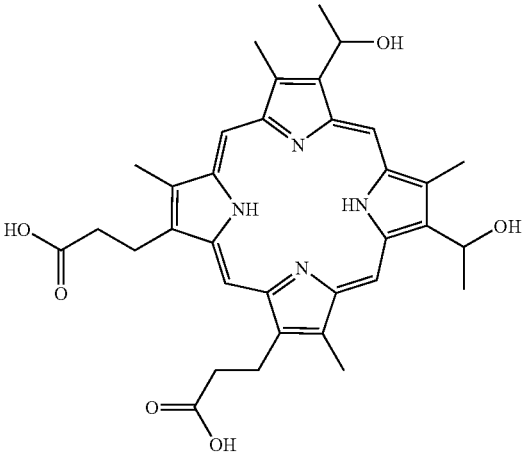
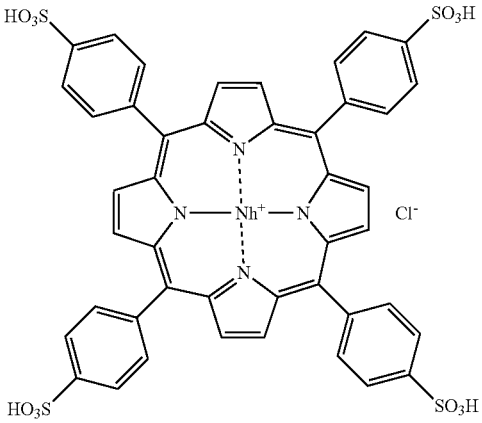
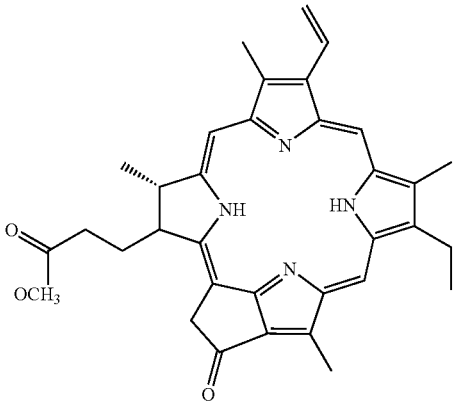
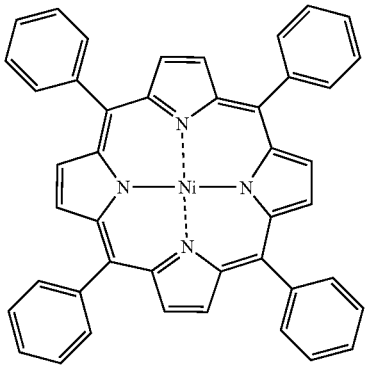
-continued
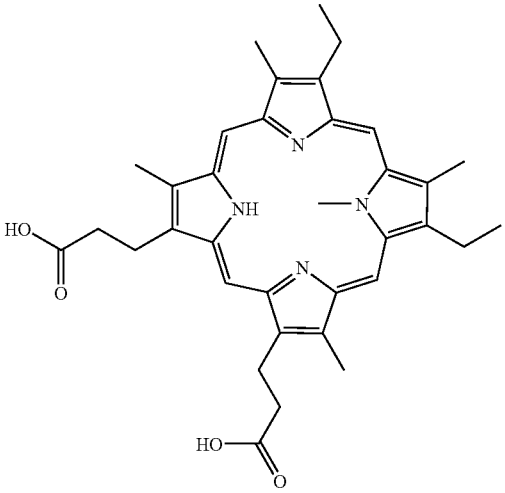
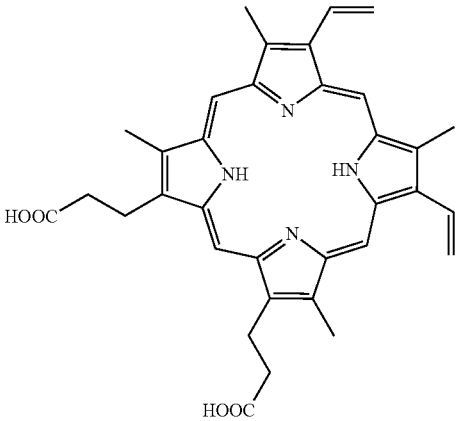
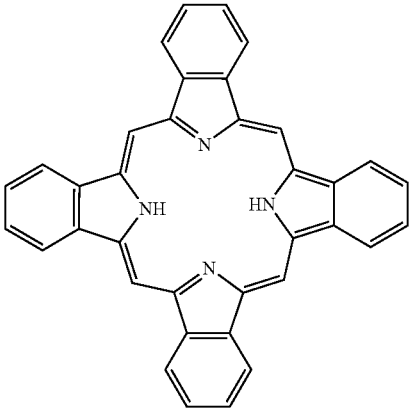

-continued

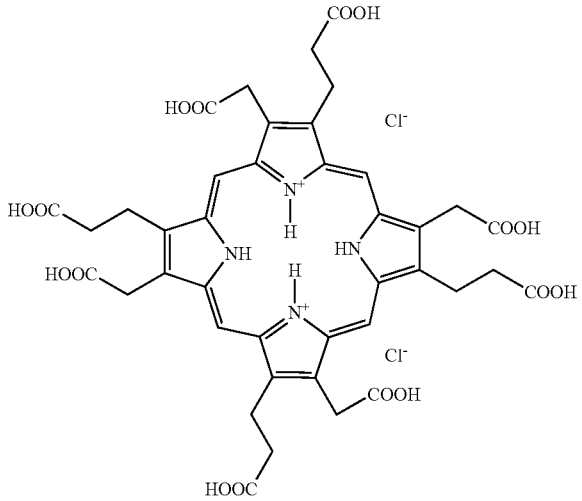

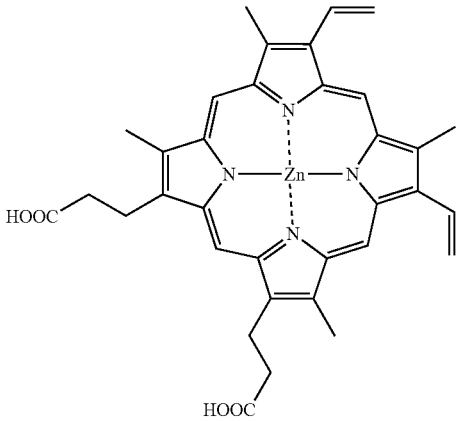

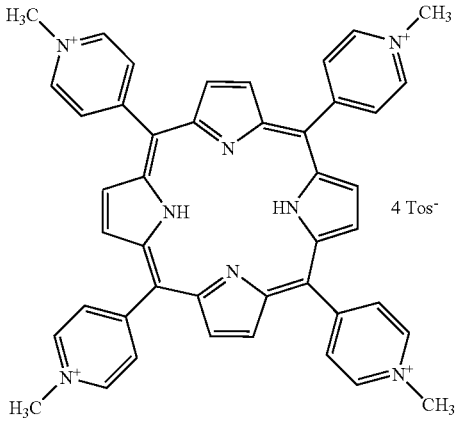

-continued

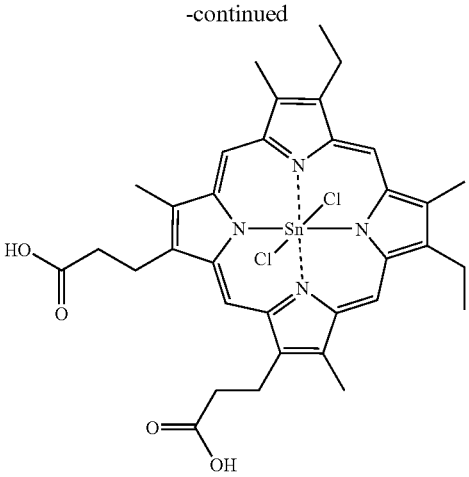

The additives comprise a porphine moiety in its structure, and the porphine additive can be either metal free or metal-containing, with metals such as Cu, Pd, V, Zn, Fe, Ga, Sn, Mn and the like. Both soluble and dispersible porphine derivatives may be used with the present embodiments.

In embodiments, porphine or porphine derivatives, like the structures shown above, are incorporated into conventional photoreceptor surface layers, namely, at least one of the charge transport layer or the overcoat layer. The charge transport layer may comprise a charge transport molecule such as aryl amines, a polymeric binder such as polycarbonate, an optional lubricant such as polytetrafluoroethylene (PTFE), and an optional antioxidant such as Irganox 1010. The porphine additive is physically mixed or dispersed into the surface layer coating solutions or dispersions used to form the charge transport layer or overcoat layer.

The porphine additive is generally present in the charge transport layer or overcoat layer at a weight concentration of from about 0.001% to about 30%, particularly from about 0.01% to about 20%, and more particularly from about 0.1% to about 10%.

In various embodiments, the charge transport layer has a thickness of from about 5 μm to about 100 μm, or from about 10 μm to about 50 μm, or from about 20 μm to about 30 μm. The porphine additive may be present in an amount of from about 0.001 percent to about 30 percent by weight of the total weight of the charge transport layer.

In various embodiments, the overcoat layer has a thickness of from about 0.1 μm to about 15 μm, or from about 1 μm to about 10 μm, or from about 2 μm to about 5 μm. The porphine additive may be present in an amount of from about 0.001 percent to about 30 percent by weight of the total weight of the overcoat layer.

The charge transport layer or the overcoat layer may consist of one, one or more, or a mixture thereof, of porphine structures, such as those porphine structures provided above.

In embodiments, the porphine additive is physically mixed or dispersed into the charge transport layer or overcoat layer formulation. Some methods that can be used to incorporate an additive into a formulation to form a charge transport layer or overcoat layer include the following: (1) simple mixing of a porphine additive, with a charge transport layer/overcoat layer formulation, with the formulation being previously dispersed before adding the porphine or its derivative (2) milling a porphine additive with the charge transport layer/overcoat layer formulation.

After forming the dispersion for the charge transport layer, the dispersion is coated on the imaging member substrate. The coating having the porphine additive is applied onto the substrate and subsequently dried to form the charge transport layer.

The charge transport layer may be applied or coated onto a substrate by any suitable technique known in the art, such as spraying, dip coating, draw bar coating, gravure coating, silk screening, air knife coating, reverse roll coating, vacuum deposition, chemical treatment and the like. Additional vacuuming, heating, drying and the like, may be used to remove any solvent remaining after the application or coating to form the charge transport layer.

After forming the dispersion for the overcoat layer, the dispersion is coated onto the imaging layer, such as the charge transport layer. The coating having the porphine additive is subsequently dried, after application, to form the overcoat layer.

The overcoat layer may be applied or coated onto a substrate by any suitable technique known in the art, such as spraying, dip coating, draw bar coating, gravure coating, silk screening, air knife coating, reverse roll coating, vacuum deposition, chemical treatment and the like. Additional vacuuming, heating, drying and the like, may be used to remove any solvent remaining after the application or coating to form the overcoat layer.

In particular embodiments, the porphine additive is present in both the charge transport layer and the overcoat layer in any combination of amounts as described in the ranges provided for above.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Comparative Example I

A controlled charge transport layer dispersion was prepared as follows: an aryl amine, N,N'-diphenyl-N,N-bis(3-methylphenyl)-1,1'-biphenyl-4,4'-diamine (5.38 grams), a film forming polymer binder PCZ 400 [poly(4,4'-dihydroxydiphenyl-1-1-cyclohexane, Mw=40,000)] available from Mitsubishi Gas Chemical Company, Ltd. (7.13 grams), and PTFE POLYFLON L-2 microparticle (1 gram) available from Daikin Industries were dissolved/dispersed in a solvent mixture of 20 grams of tetrahydrofuran (THF) and 6.7 grams of toluene via CAVIPRO 300 nanomizer (Five Star technology, Cleveland, Ohio) (all-in-one process, 10/14 mixing elements, 7500 psi, 5 passes). The resulting controlled dispersion was filtered with a 20-micrometer pore size nylon cloth.

Example I

An invented charge transport layer dispersion was prepared as follows: an aryl amine, N,N'-diphenyl-N,N-bis(3-methylphenyl)-1,1'-biphenyl-4,4'-diamine (5.38 grams), a film forming polymer binder PCZ 400 [poly(4,4'-dihydroxydiphenyl-1-1-cyclohexane, Mw=40,000)] available from Mitsubishi Gas Chemical Company, Ltd. (7.13 grams), PTFE POLYFLON L-2 microparticle (1 gram) available from Daikin Industries, and meso-tetraphenylporphine-4,4',4",4'"-tetracarboxylic acid available from Frontier Scientific, Inc., Logan, Utah (0.034 grams) were dissolved/dispersed in a solvent mixture of 20 grams of tetrahydrofuran (THF) and 6.7 grams of toluene via CAVIPRO 300 nanomizer (Five Star technology, Cleveland, Ohio) (all-in-one process, 10/14 mixing elements, 7500 psi, 5 passes). The resulting invented dispersion was filtered with a 20-micrometer pore size nylon cloth.

Example II

A second invented charge transport layer dispersion was prepared as follows: an aryl amine, N,N'-diphenyl-N,N-bis(3-methylphenyl)-1,1'-biphenyl-4,4'-diamine (5.38 grams), a film forming polymer binder PCZ 400 [poly(4,4'-dihydroxydiphenyl-1-1-cyclohexane, Mw=40,000)] available from Mitsubishi Gas Chemical Company, Ltd. (7.13 grams), PTFE POLYFLON L-2 microparticle (1 gram) available from Daikin Industries, and 8,13-Bis(vinyl)-3,7,12,17-tetramethyl-21H,23H-porphine-2,18-dipropionic acid zinc(II) available from Frontier Scientific, Inc., Logan, Utah (0.034 grams) were dissolved/dispersed in a solvent mixture of 20 grams of tetrahydrofuran (THF) and 6.7 grams of toluene via CAVIPRO 300 nanomizer (Five Star technology, Cleveland, Ohio) (all-in-one process, 10/14 mixing elements, 7500 psi, 5 passes). The resulting invented dispersion was filtered with a 20-micrometer pore size nylon cloth.

Three photoreceptor devices were prepared with the above charge transport layer dispersions, respectively. They were all coated on the same undercoat layer and charge generation layer. The undercoat layer is 3-component undercoat layer which was prepared as follows: Zirconium acetylacetonate tributoxide (about 35.5 parts), γ-aminopropyltriethoxysilane (about 4.8 parts) and poly(vinyl butyral) (about 2.5 parts) were dissolved in n-butanol (about 52.2 parts) to prepare a coating solution. The coating solution was coated via a ring coater, and the layer was pre-heated at about 59° C. for about 13 minutes, humidified at about 58° C. (dew point of 54° C.) for about 17 minutes, and then dried at about 135° C. for about 8 minutes. The thickness of the undercoat layer on each photoreceptor was approximately 1.3 μm. The charge generation layer dispersion was prepared as follows: 2.7 grams of chlorogallium phthalocyanine (ClGaPc) Type B pigment was mixed with 2.3 grams of polymeric binder VMCH (Dow Chemical), 30 grams of xylene and 15 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 6 weight percent with the solvent mixture of xylene/n-butyl acetate (weight/weight ratio=2/1). The ClGaPc charge generation layer dispersion was applied on top of the above undercoat layer, respectively. The thickness of the charge generation layer was approximately 0.2 μm.

Subsequently, a 29-μm charge transport layer was coated on top of the charge generation layer from the above charge transport layer dispersions, respectively (Comparative Example I in Device I, Example I in Device II and Example II in Device III). The charge transport layer was dried at about 120° C. for about 40 minutes.

The above prepared photoreceptor devices were tested in a scanner set to obtain photo induced discharge curves, sequenced at one charge-erase cycle followed by one charge-expose-erase cycle, wherein the light intensity was incrementally increased with cycling to produce a series of photo induced discharge characteristic curves (PIDC) from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters. The exposure light source was a 780-nanometer light emitting diode. The aluminum drum was rotated at a speed of about 61 revolutions per minute to produce a surface speed of about 122 millimeters per second. The xerographic simulation was completed in an environmentally controlled light tight chamber at ambient conditions (about 50 percent relative humidity and about 22° C.).

Very similar photo-induced discharge curves (PIDC) were observed for all the photoreceptor devices, thus the incorporation of the porphine additive into charge transport layer does not adversely affect PIDC.

The above photoreceptor devices were then acclimated for 24 hours before testing in A-zone (85° F./80% Room Humidity). Print tests were performed in Copeland Work centre using black and white copy mode to achieve machine speed of 208 mm/s. Ghosting levels were measured against an empirical scale, where the smaller the ghosting grade level, the better the print quality. In general, a ghosting grade reduction of 1 to 2 levels was observed when the porphine additive was incorporated in charge transport layer. Therefore, incorporation of the porphine additive in charge transport layer significantly improves print quality such as ghosting.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An electrophotographic imaging member, comprising:

a substrate;

a charge generating layer disposed over the substrate;

a charge transport layer disposed over the generating layer having a charge transport material dispersed therein; and an overcoat layer disposed over the charge transport layer, wherein at least one of the charge transport layer and overcoat layer includes a porphine additive of the following modified structure:

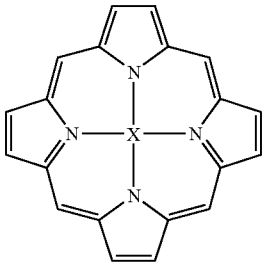

wherein X is a metal selected from the group consisting of Cu, Pd, V, Zn, Fe, Ga, Sn, Mn and mixtures thereof; or a porphine additive comprising a porphine material selected from the group consisting of 21H, 23H-Porphine, meso-Tetraphenylporphine-4,4',4",4'"-tetracarboxylic acid, 5,10,15,20-Tetra(4-pyridyl)-21H, 23H-porphine, 5,10,15,20-Tetraphenyl-21H, 23H-porphine, 5,10,15,20-Tetrakis(o-dichlorophenyl)-21H, 23H-porphine, 5,10,15,20-Tetrakis(4-trimethylammoniophenyl) porphine tetrachloride, Phytochlorin, 5,10,15,20-Tetrakis(3-hydroxyphenyl)-21H, 23H-porphine, 3,8,13,18-Tetramethyl-21H, 23H-porphine-2,7,12,17-tetrapropionic acid dihydrochloride, 3,7,12,17-Tetramethyl-21H, 23H-porphine-2,18-dipropionic acid dihydrochloride, 8,13-Bis(1-hydroxyethyl)-3,7,12,17-tetramethyl-21H, 23H-porphine-2,18-dipropionic acid, Pyropheophorbide-α-methyl ester, N-Methyl Mesoporphyrin IX, 8,13-Bis(vinyl)-3,7,12,17-tetramethyl-21H, 23H-porphine-2,18-dipropionic acid, Uroporphyrin 1 dihydrochloride, 5,10,15,20-Tetrakis (1-methyl-4-pyridinio) porphine tetra (p-toluencsulfonate), and mixtures thereof; and wherein the porphine additive is present in an amount of from about 0.001 percent to about 30 percent by weight of total solids in the at least one of the charge transport layer and overcoat layer.

2. The electrophotographic imaging member of claim 1, wherein the porphine additive of the modified structure comprises a porphine material selected from the group consisting of meso-Tetraphenylporphine-4,4',4",4'"-tetracarboxylic acid copper (II), 5,10,15,20-Tetrakis(4-sulfonatophenyl)-21H, 23H-porphine copper(II), 5,10,15,20-Tetrakis(pentafluorophenyl)-21H, 23H-porphine palladium(II), 2,3,7,8,12,13,17,18-Octaethyl-21H, 23H-porphine vanadium (IV) oxide, 8,13-Divinyl-3,7,12,17-tetramethyl-21H, 23H-porphine-2, 18-dipropionic acid cobalt(III) chloride, 8,13,-Bis(ethyl)-3,7,12,17-tetramethyl-21H, 23H-porphine-2, 18-dipropionic acid chromium(III) chloride, meso-Tetraphenylporphine-4,4',4",4'"-tetracarboxylic acid, iron (III) chloride, 5,10,15,20-Tetrakis(4-sulfonatophenyl)-21H, 23H-porphine, manganese (III) chloride, 5,10,15,20-Tetraphenyl-21H, 23H-porphine nickel(II), 8,13-Bis(vinyl)-3,7,12,17-tetramethyl-21H, 23H-porphine-2,18-dipropionic acid zinc (II), 8,13-Bis(ethyl)-3,7,12,17-tetramethyl-21H, 23H-porphine-2,18-dipropionic acid tin(IV) dichloride, and mixtures thereof.

3. The electrophotographic imaging member of claim 1, wherein the porphine additive is present in an amount of from about 0.01 percent to about 20 percent by weight of total solids in the at least one of the charge transport layer and overcoat layer.

4. The electrophotographic imaging member of claim 3, wherein the porphine additive is present in an amount of from about 0.1 percent to about 10 percent by weight of total solids in the at least one of the charge transport layer and overcoat layer.

5. The electrophotographic imaging member of claim 1, wherein the porphine additive is present in both of the charge transport layer and the overcoat layer.

6. The electrophotographic imaging member of claim 1, wherein the charge transport layer has a thickness of from about 5 μm to about 100 μm.

7. The electrophotographic imaging member of claim 1, wherein the overcoat layer has a thickness of from about 0.1 μm to about 15 μm.

8. The electrophotographic imaging member of claim 1, wherein the charge transport material includes a polymeric binder.

9. An electrophotographic imaging member, comprising:

a substrate;

a charge generating layer disposed over the substrate;

a charge transport layer disposed over the generating layer having a charge transport material dispersed therein; and an overcoat layer disposed over the charge transport layer, wherein both the charge transport layer and the overcoat layer include a porphine additive of the following modified structure:

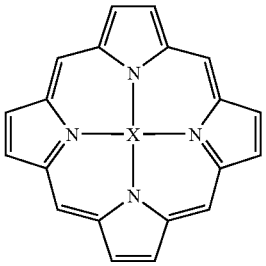

wherein X is a metal selected from the group consisting of Cu, Pd, V, Zn, Fe, Ga, Sn, Mn and mixtures thereof; or a porphine additive comprising a porphine material selected from the group consisting of 21H, 23H-Porphine, meso-Tetraphenylporphine-4,4',4",4'"-tetracarboxylic acid, 5,10,15,20-Tetra(4-pyridyl)-21H, 23H-porphine, 5,10,15,20-Tetraphenyl-21H, 23H-porphine, 5,10,15,20-Tetrakis(o-dichlorophenyl)-21H, 23H-porphine, 5,10,15,20-Tetrakis(4-trimethylammoniophenyl) porphine tetrachloride, Phytochlorin, 5,10,15,20-Tetrakis(3-hydroxyphenyl)-21H, 23H-porphine, 3,8,13,18-Tetramethyl-21H, 23H -porphine-2,7,12,17-tetrapropionic acid dihydrochloride, 3,7,12,17-Tetramethyl-21H, 23H -porphine-2,18-dipropionic acid dihydrochloride, 8,13-Bis(1-hydroxyethyl)-3,7,12,17-tetramethyl-21H, 23H-porphine-2,18-dipropionic acid, Pyropheophorbide-α-methyl ester, N-Methyl Mesoporphyrin IX, 8,13-Bis(vinyl)-3,7,12,17-tetramethyl-21H, 23H-porphine-2,18-dipropionic acid, Uroporphyrin I dihydrochloride, 5,10,15,20-Tetrakis (1-methyl-4-pyridinio) porphine tetra (p-toluenesulfonate), and mixtures thereof; and wherein the porphine additive is present in an amount of from about 0.001 percent to about 30 percent by weight of total solids in the charge transport layer, and the porphine additive is present in an amount of from about 0.001 percent to about 30 percent by weight of total solids in the overcoat layer.

10. An image forming apparatus for forming images on a recording medium comprising:

a) an electrophotographic imaging member having a charge retentive-surface to receive an electrostatic latent image thereon, wherein the electrophotographic imaging member comprises a substrate, a charge generating layer disposed over the substrate, a charge transport layer disposed over the generating layer having a charge transport material dispersed therein, and an overcoat layer disposed over the charge transport layer, wherein at least one of the charge transport layer and overcoat layer includes a porphine additive of the following modified structure:

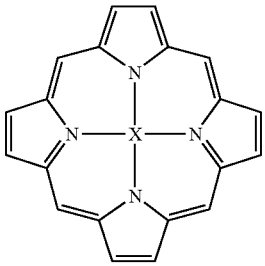

wherein X is a metal selected from the group consisting of Cu, Pd, V, Zn, Fe, Ga, Sn, Mn and mixtures thereof; or a porphine additive comprising a porphine material selected from the group consisting of 21H, 23H-Porphine, meso-Tetraphenylporphine-4,4',4",4'"-tetracarboxylic acid, 5,10,15,20-Tetra(4-pyridyl)-21H, 23H-porphine, 5,10,15,20-Tetraphenyl-21H, 23H-porphine, 5,10,15,20-Tetrakis(o-dichlorophenyl)-21H, 23H-porphine, 5,10,15,20-Tetrakis(4-trimethylammoniophenyl) porphine tetrachloride, Phytochlorin, 5,10,15,20-Tetrakis(3-hydroxyphenyl)-21H, 23H-porphine, 3,8,13,18-Tetramethyl-21H, 23H -porphine-2,7,12,17-tetrapropionic acid dihydrochloride, 3,7,12,17-Tetramethyl-21H, 23H -porphine-2,18-dipropionic acid dihydrochloride, 8,13-Bis(1-hydroxyethyl)-3,7,12,17-tetramethyl-21H, 23H-porphine-2,18-dipropionic acid, Pyropheophorbide-α-methyl ester, N-Methyl Mesoporphyrin IX, 8,13-Bis(vinyl)-3,7,12,17-tetramethyl-21H, 23H-porphine-2,18-dipropionic acid, Uroporphyrin 1 dihydrochloride, 5,10,15,20-Tetrakis(1-methyl-4-pyridinio) porphine tetra (p-toluenesulfonate), and mixtures thereof; and b) a development component adjacent to the charge-retentive surface for applying a developer material to the charge-retentive surface to develop the electrostatic latent image to form a developed image on the charge-retentive surface;

c) a transfer component adjacent to the charge-retentive surface for transferring the developed image from the charge-retentive surface to a copy substrate; and d) a fusing component adjacent to the copy substrate for fusing the developed image to the copy substrate;

wherein the porphine additive is present in an amount of from about 0.001 percent to about 30 percent by weight of total solids in the at least one of the charge transport layer and overcoat layer.

11. The image forming apparatus of claim 10, wherein the porphine additive of the modified structure comprises a porphine material selected from the group consisting of meso-Tetraphenylporphine-4,4',4",4'"-tetracarboxylic acid copper (II), 5,10,15,20-Tetrakis(4-sulfonatophenyl)-21H, 23H-porphine copper(II), 5,10,15,20-Tetrakis(pentafluorophenyl)-21H, 23H-porphine palladium(II), 2,3,7,8,12,13,17,18-Octaethyl-21H, 23H-porphine vanadium (IV) oxide, 8,13-Divinyl-3,7,12,17-tetramethyl-21H, 23H-porphine-2,18-dipropionic acid cobalt(III) chloride, 8,13,-Bis(ethyl)-3, 7,12,17-tetramethyl-21H, 23H-porphine-2, 18-dipropionic acid chromium(III) chloride, meso-Tetraphenylporphine-4, 4',4",4'"-tetracarboxylic acid, iron (III) chloride, 5,10,15,20-Tetrakis(4-sulfonatophenyl)-21H, 23H-porphine, manganese (III) chloride, 5,10,15,20-Tetraphenyl-21H, 23H-porphine nickel(II), 8,13-Bis(vinyl)-3,7,12,17-tetramethyl-21H, 23H-porphine-2,18-dipropionic acid zinc(II), 8,13-Bis(ethyl)-3,7,12,17-tetramethyl-21H, 23H-porphine-2,18-dipropionic acid tin(IV) dichloride, and mixtures thereof.

12. The image forming apparatus of claim 10, wherein the porphine additive is present in an amount of from about 0.01 percent to about 20 percent by weight of total solids in the at least one of the charge transport layer and overcoat layer.

13. The image forming apparatus of claim 10, wherein the porphine additive is present in an amount of from about 0.1 percent to about 10 percent by weight of total solids in the at least one of the charge transport layer and overcoat layer.

14. The image forming apparatus of claim 10, wherein the porphine additive is present in both of the charge transport layer and the overcoat layer.

15. The image forming apparatus of claim 10, wherein the charge transport layer has a thickness of from about 5 μm to about 100 μm.

16. The image forming apparatus of claim 10, wherein the overcoat layer has a thickness of from about 0.1 μm to about 15 μm.

* * * * *